US007696420B2

(12) United States Patent
Thompson

(10) Patent No.: US 7,696,420 B2
(45) Date of Patent: Apr. 13, 2010

(54) STRING BENDER FOR ELECTRIC GUITAR

(76) Inventor: Donald J. Thompson, 803 Bradford St., Belding, MI (US) 48809

( * ) Notice: Subject to any disclaimer, the term of this patent is extended or adjusted under 35 U.S.C. 154(b) by 238 days.

(21) Appl. No.: 11/949,097

(22) Filed: Dec. 3, 2007

(65) Prior Publication Data

US 2008/0141843 A1 Jun. 19, 2008

Related U.S. Application Data

(60) Provisional application No. 60/870,137, filed on Dec. 15, 2006.

(51) Int. Cl.
*G10D 3/10* (2006.01)
*G10D 3/00* (2006.01)

(52) U.S. Cl. ..... 84/313; 84/173; 84/267; 84/297 R; 84/299

(58) Field of Classification Search ..... 84/313
See application file for complete search history.

(56) References Cited

U.S. PATENT DOCUMENTS 2,949,806 A * 8/1960 Turman ..... 84/297 R
3,479,917 A 11/1969 Zitnik, Jr. et al.
3,512,443 A * 5/1970 Parson et al. ..... 84/313
3,686,993 A * 8/1972 Fender ..... 84/312 R
4,535,670 A 8/1985 Borisoff
5,140,884 A * 8/1992 Bowden ..... 84/312 R
5,413,019 A * 5/1995 Blanda, Jr. ..... 84/298
D361,779 S 8/1995 Lambert, Jr.
5,481,954 A 1/1996 Parsons
5,567,897 A * 10/1996 McEwen ..... 84/312 R
6,300,550 B1 * 10/2001 Smith ..... 84/298

* cited by examiner

*Primary Examiner*—Jeffrey Donels
*Assistant Examiner*—Christopher Uhlir
(74) *Attorney, Agent, or Firm*—Price, Heneveld, Cooper, DeWitt & Litton LLP

(57) ABSTRACT

A string bender apparatus includes a mounting plate with an anchor for anchoring guitar strings to a guitar body, a first section with fastener-receiving holes arranged to receive fasteners extended into pre-existing mounting holes in the body, and an extension that extends from the first section. A lever is pivoted to the extension for movement in a plane that extends generally parallel the front surface of the guitar body. The lever includes a first end defining a handle that is positioned generally adjacent one side of the strings and includes an opposite end attached to one of the strings for temporarily changing a tension of the one string and thus changing a pitch of the one string when the handle is moved in the plane. The string bender can be retrofit onto existing guitars. The string bender can be made removable and replaced with, or combined with a vibrato.

2 Claims, 10 Drawing Sheets

STRING BENDER FOR ELECTRIC GUITAR

This application claims benefit under 35 U.S.C. §119(e) of provisional application Ser. No. 60/870,137, filed Dec. 15, 2006, entitled STRING BENDER WITH OPTIONAL VIBRATO MOUNTING PLATE FOR ELECTRIC GUITAR, the entire contents of which are incorporated herein by reference.

BACKGROUND

The present invention relates to a string bender for electric guitars that requires little or no modification to existing brands of electric guitars, and further which provides easy installation with optional retrofitability, removability, transferability/interchangeability from guitar to guitar, and simplicity of construction leading to durability/robustness of construction. Further, the present invention positions and pivotally supports its handle component for efficient/easy use while picking and playing the guitar, and for combining with other functional structures such as a vibrato.

String benders permit raising the pitch of a string on a guitar to mimic pedal steel guitar effects. To date, manufactured string benders are relatively crude in the operation of string bending. The Parsons string bender (U.S. Pat. No. 5,481,954) requires major defacement of the guitar by routing a channel in the back of the instrument and drilling a hole through guitar body. Activation of the bender is obtained by pulling the guitar downward, while wearing the guitar with a strap. These requirements make the Parsons string bender a permanent fixture on the guitar, and halts any potential for future price increases in reselling the instrument. Also, this bender can be accidentally activated and/or its return spring can fatigue over time, such that it can adversely affect pitch during "normal" playing of the guitar.

The Hip-Shot string bender device (U.S. Pat. No. 4,535,670) bolts to the end of the guitar and a metal rod is inserted that protrudes from the back of the guitar. Activation is achieved by pushing the guitar to the left, using the player's body and protruding rod to pull the string. Again, this method and device have limitations to operation. Also, disassembly of the rod is required since it hinders placement of the instrument in its protective case.

The Gibson/Bowden bender (U.S. Pat. No. 5,140,884) is a string bender that can only be used on guitars that use the Gibson style stop tailpiece. With this device mounted, the string bender handle is located in a difficult position to operate and hinders the player's right hand and playing technique. Also, the guitar cannot be placed in its case without removing string tension and turning the device 90 degrees. Again, this configuration has very limited appeal for the guitar player.

The Bigsby Palm Pedal (U.S. Pat. No. 3,479,917) is another string bender device that requires drilling apertures or holes in the top of the instrument for attachment, making it a permanent fixture on the guitar. The Bigsby palm pedal string bender can bend both the G and the B string. However, once mounted, the activation handles are suspended over the guitar bridge and again hinders the player's right hand and playing technique. Also, its location inhibits placement in its protective case.

A Timara string bender is a device that requires the activating arms to be bolted in place for operation and requires moving the right arm to activate. The arms rise above the strings, interfere with "normal" guitar playing, and must be unbolted for placement in case.

A Shelton string bender is very much the same as the Parsons string bender. It requires major routing and activates the string bender by means of the guitar strap pulling down on the guitar body and neck. This results in limitations as noted in regard to the Parsons string bender discussed above.

It is important that the activity of picking/playing/strumming guitar strings, which occurs primarily over the body of the guitar near the sound pickups, not be interfered with. Further, it is desirable that use of a string bender be easily accomplished and that it be able to be integrated into the act of picking/playing/strumming. In other words, it is important to provide easy and efficient access to the lever for operating a string bender, while not interfering with normal picking/playing/strumming of the guitar. It is also desirable to provide a string bender apparatus that does not interfere with storage of the guitar in most cases.

Furthermore, it would be desirable to provide guitar players who would like to have a guitar with a vibrato tailpiece or a string bender tailpiece the option of installing the vibrato or bender tailpiece without routing or drilling the existing instrument. Most guitar players have declined to add a Bigsby tailpiece, because it requires drilling four mounting apertures or holes into the guitar, which can reduce the resale value of the instrument by 60% to 80%. It would be desirable to provide a mounting plate capable of supporting the Bigsby tailpiece, while eliminating the need to deface or puncture the original instrument by drilling or routing.

In addition, the above discussed mechanisms often include many components and are more complex than desired, each of which increase manufacturing expense (due to part costs and also assembly costs), increase warranty due to wear and poor durability, and increase installation costs.

SUMMARY OF THE PRESENT INVENTION

In one aspect of the present invention, a string bender apparatus is provided for a guitar, where the guitar has a guitar body with a front surface and a plurality of guitar strings extending generally parallel the front surface. The guitar body further has a pattern of mounting holes for mounting a tailpiece to the body for anchoring the strings to the body. The apparatus includes a mounting plate with an anchor for anchoring the strings, a first section with fastener-receiving holes adapted to receive fasteners extended into the mounting holes for attaching the mounting plate to the body, and an extension that extends from the first section. A lever is pivoted to the extension for pivotal movement in a plane that extends generally parallel the front surface of the guitar body. The lever includes a first end defining a handle that is positioned generally adjacent one side of the strings and includes an opposite end attached to one of the strings for temporarily changing a tension of the one string and thus changing a pitch of the one string when the handle is moved in the plane.

In another aspect of the present invention, a guitar includes a guitar body with a front surface. A plurality of guitar strings extend generally parallel the front surface. The guitar body has a tailpiece anchoring the strings to the body. A bender lever is pivoted to the guitar body for pivotal movement about a pivot axis extending generally perpendicular to the front surface so that the lever moves in a plane that extends generally parallel the front surface of the guitar body. The lever includes a first end defining a handle that is positioned generally adjacent one side of the strings and further includes an opposite end attached to one of the strings for temporarily changing a tension of the one string and thus changing a pitch of the one string when the handle is moved in the plane.

In another aspect of the present invention, an apparatus includes a guitar having a body with a front surface defining a plane and having a mounting plate attached to the body. A string bender includes a first lever adapted to be pivoted to the mounting plate for movement; the first lever including a first end defining a handle that is positioned generally adjacent the strings when the strings are in the string-tensioned arrangement and including an opposite end attached to one of the strings for temporarily changing a tension of the one string and thus changing a pitch of the one string when the handle is moved. A vibrato includes a second lever adapted to be pivoted to the mounting plate for movement, the second lever including a handle end positioned generally adjacent the strings when the strings are in the string-tensioned arrangement and including another end attached to all of the strings for temporarily changing a tension of all of the strings and thus changing their pitch when the second lever is moved. By this arrangement, the string bender and the vibrato can be selectively attached to the mounting plate.

In another aspect of the present invention, a method of retrofitting a guitar with a new function, comprises steps of providing a guitar having a body with a front surface defining a plane and having a tailpiece anchor attached to the body using fasteners and pre-existing fastener holes arranged in a known pattern, the tailpiece anchor anchoring guitar strings to the body over the front surface in a string-tensioned arrangement. The method further includes removing the guitar strings and removing the fasteners, and then removing the tailpiece. A string bender is provided that includes a mounting plate with holes matching the known pattern and a lever pivoted to the mounting plate for movement; the lever including a first end defining a handle that is positioned generally adjacent one side of the strings when the strings are in the string-tensioned arrangement and including an opposite end attached to one of the strings for temporarily changing a tension of the one string and thus changing a pitch of the one string when the handle is moved. The method includes attaching the mounting plate to the body by extending the fasteners through the holes into the pre-existing fastener holes in the body, and re-attaching the strings by attaching most strings to the mounting plate but also attaching at least one of the strings to the opposite end of the lever.

In another aspect of the present invention, a method of transferring a bender plate from a first guitar to a second guitar, comprises steps of providing first and second guitars; each guitar having a body with a front surface defining a plane and having a tailpiece anchor attached to the body using fasteners and pre-existing fastener holes arranged in a known pattern, the tailpiece anchor anchoring guitar strings to the body over the front surface in a string-tensioned arrangement. The tailpiece anchor of the first guitar includes a string bender that includes a mounting plate with holes matching the known pattern and a lever pivoted to the mounting plate for movement. The lever includes a first end defining a handle that is positioned generally adjacent the strings when the strings are in the string-tensioned arrangement and includes an opposite end attached to one of the strings for temporarily changing a tension of the one string and thus changing a pitch of the one string when the handle is moved. The method includes removing the tailpiece anchors of the first and second guitars, and re-attaching the tailpiece anchor of the first guitar onto the second guitar.

In yet another aspect of the present invention, a method of changing a guitar, comprises steps of providing a guitar having a body with a front surface defining a plane and having a mounting plate attached to the body; providing a string bender including first lever adapted to be pivoted to the mounting plate for movement. The first lever includes a first end defining a handle that is positioned generally adjacent the strings when the strings are in the string-tensioned arrangement and includes an opposite end attached to one of the strings for temporarily changing a tension of the one string and thus changing a pitch of the one string when the handle is moved; and providing a vibrato including a second lever adapted to be pivoted to the mounting plate for movement. The second lever includes a handle end positioned generally adjacent the strings when the strings are in the string-tensioned arranged and including another end attached to all of the strings for temporarily changing a tension of all of the strings and thus changing their pitch when the second lever is moved. The method further includes selectively attaching the string bender and the vibrato to the mounting plate.

An aspect of one embodiment of the present invention is that a string bender mounting plate according to an embodiment of the present invention can use a string bender handle and pivot stops for the string bender, or by removing the handle and pivot stops, becomes a mounting plate attachment or frame for the world famous Bigsby B5 Vibrato unit without having to drill apertures or holes in the instrument, and can be easily moved from instrument to instrument.

A significant advantage of the present invention is the simplicity of installation, and the fact that installation will not deface the instrument, preserving the value of the instrument for future resale. Once installed, the handle is located in an easy to operate position without hindering the player's right hand and playing technique.

All instruments using a string bender device according to an embodiment of the present invention can be safely placed in the original factory case (without removal of the device) and without modification to the case.

According to another aspect of the present invention, a mounting plate attachment or frame for the electric guitar is provided that has the potential to revolutionize the guitar industry. The mounting plate according to an embodiment of the present invention allows for the addition of a Bigsby Vibrato tailpiece to be mounted to a guitar without the need of drilling mounting apertures in the face of the instrument. The Bigsby Vibrato tailpiece requires drilling four apertures or holes in the top of the instrument for mounting. The mounting plate of frame according to the present invention allows the Bigsby tailpiece to be first mounted to the mounting plate or frame using the normal bolt pattern of the Bigsby tailpiece, and allows the mounting plate to be bolted to the guitar body using the existing attachment holes/structure.

The mounting plate or frame according to an embodiment of the present invention, with the Bigsby tailpiece installed, mounts to the instrument's top using the two existing 5/16 inch bolt apertures on the guitar that were factory installed and intended for what is known as a stop tailpiece. Thus, the player can add the Bigsby vibrato tailpiece with a mounting plate according to the present invention for as long as the player wants. The player can at any time return the guitar to factory original with no damage or alterations made to the guitar.

Some advantages with a mounting plate system according to the present invention is the plate, and the Bigsby vibrato can be moved from guitar to guitar with a simple five minute string change. The mounting plate according to the present invention can be quickly and easily installed on any Gibson, Epiphone or any guitar that has a standard two bolt tailpiece which has been an industry standard for almost fifty years and continues to be the standard in today's guitar building.

Another advantage with the mounting plate or frame according to the present invention is that it can be used on hundreds of models of guitars, and that the cost and age of the instrument has no bearing on installation. The guitar can be brand new, or it can be a fifty year old classic, and can have the mounting plate or frame, according to an embodiment of the present invention, and the Bigsby installed in five minutes with only a change of strings.

Until now, there is nothing on the market that allows this very simple, quick installation of the Bigsby vibrato tailpiece. As a result, the installation of the Bigsby vibrato tailpiece was best left to a professional guitar repairman with additional costs and four new holes or apertures in the top of the instrument, making it a permanent vibrato on the guitar. Now, even a novice can install a Bigsby Vibrato using the mounting plate according to an embodiment of the present invention, restring the instrument and tune the instrument in under fifteen minutes with perfect alignment.

Bigsby has been manufacturing their guitar vibrato since 1947 and have always been thought of as the "Cadillac" of the vibrato industry. This will change the way guitar players view adding a vibrato to a cherished and valued instrument.

Guitar players, who would love to have a guitar with a string bender and/or vibrato tailpiece, have declined to make the modifications, because installation requires routing a pocket in the guitar and drilling mounting apertures or holes. This modification during installation makes attachment of a string bender and/or vibrato tailpiece device permanent and can reduce the resale value of the instrument by 60% to 80%.

A string bender and/or vibrato mounting plate or frame attachment according to an embodiment of the present invention for an electric guitar also has the potential to revolutionize the guitar industry. A string bender mounting plate or frame according to an embodiment of the present invention allows the addition of a Bigsby Vibrato tailpiece, or a B string/G string bender, to be attached to the guitar without the need of routing or drilling mounting apertures in the face of the instrument. Activation of bending the B string or G string (guitar player's choice of which string to activate) is a simple handle that is placed near the guitar player's right hand, out of the way, yet easy to reach and activate with the little finger on the right hand. The placement of the handle does not hinder the player's right hand technique when not in operation. Operation of the string bender devices which are on the market today, requires either pushing down the guitar wearing a guitar strap, or shoving the guitar in a sideways movement to activate the bending operation, which requires a "different" movement by the guitar player thus affecting his playing technique. Also, it is difficult to control those devices activated by pushing down on the guitar strap, since small pressure on the guitar strap affects the string's tone at times when it is undesirable to do so.

Some of the advantages of a string bender mounting plate or frame according to an embodiment of the present invention are that it uses the guitar's existing factory-drilled apertures and the guitar's original bridge inserts. Using existing factory-drilled apertures insures perfect alignment in order to keep the strings straight to the guitar neck and fret board. Also, using existing fasteners and bridge components reduces cost.

A string bender device according to an embodiment of the present invention can be installed on the guitar in as little as fifteen minutes. A string bender device according to an embodiment of the present invention is handsome in appearance and capable of producing tones of great beauty. A string bender system according to an embodiment of the present invention can be transferred from one guitar to another guitar and can be installed on a $100 instrument as well as a $10,000 guitar without altering or defacing the instrument. The guitar can be brand new, or it can be a fifty year old prized classic. The player can at any time return the guitar to factory original to maintain the highest resale value.

The string bender and/or vibrato combination system according to another aspect of the present invention has been designed and manufactured to fit the Gibson, Epiphone, and Fender brand electric guitars, which have been the industry standards for almost fifty years, and continue to be the dominant standards in today's music industry. Other brands' models can be designed and manufactured as desired, when the demand calls for more models. The string bender and/or vibrato combination system can be used on hundreds of brand name models of guitars.

Until now, there has been nothing on the market that allows this very simple quick installation and transferability of the B or G string bender and/or vibrato tailpiece. The installation of available types of string benders on the market today are best left to a professional guitar repairman, incurring additional installation costs and defacing the instrument.

Now even a novice can install a string bender and/or vibrato combination system according to an embodiment of the present invention, and restring the guitar in under fifteen minutes with perfect alignment.

The string bender and/or vibrato combination system will change the way guitar players view the task of adding a string bender and/or vibrato combination system to a cherished and valued instrument.

Further, the appearance/design of the present invention is believed to be novel, ornamental, unobvious, and distinctive over prior art in surprising and unexpected ways, and hence is believed to be patentable.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
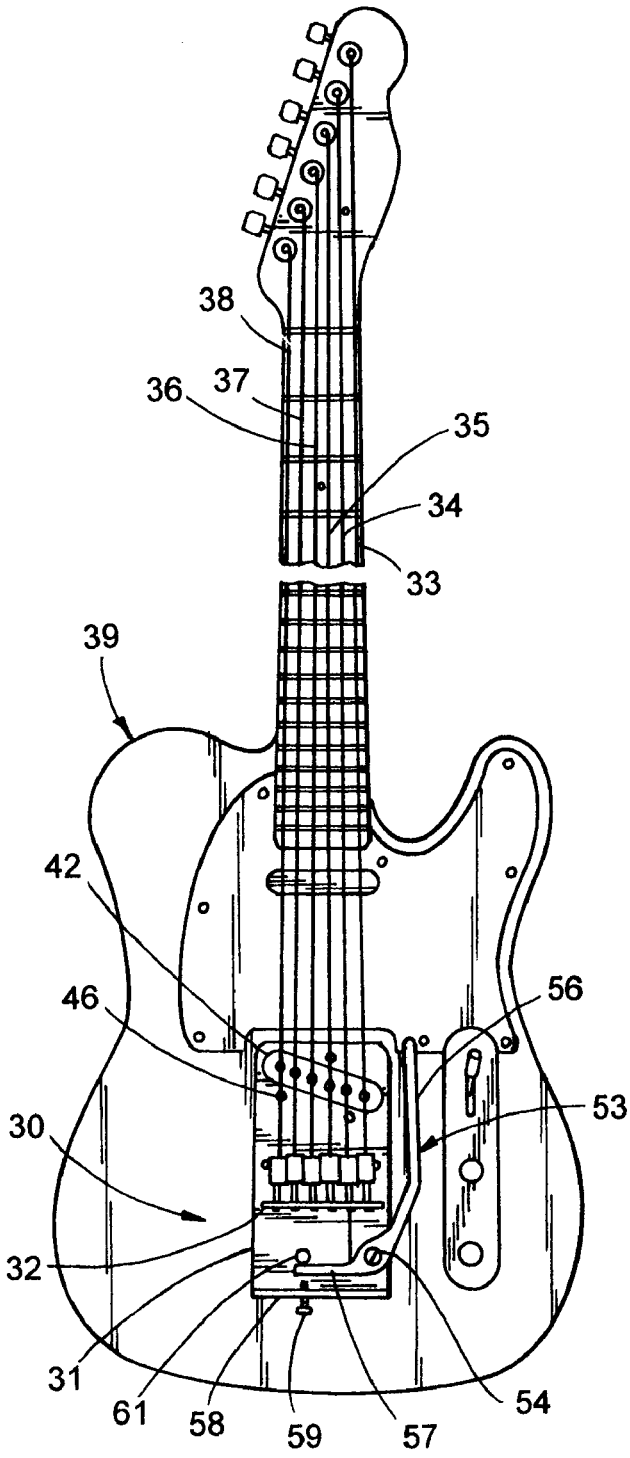
FIGS. 1-2 are front and bottom views of a guitar with a first embodiment of the present inventive string bender thereon.
Figure 2:
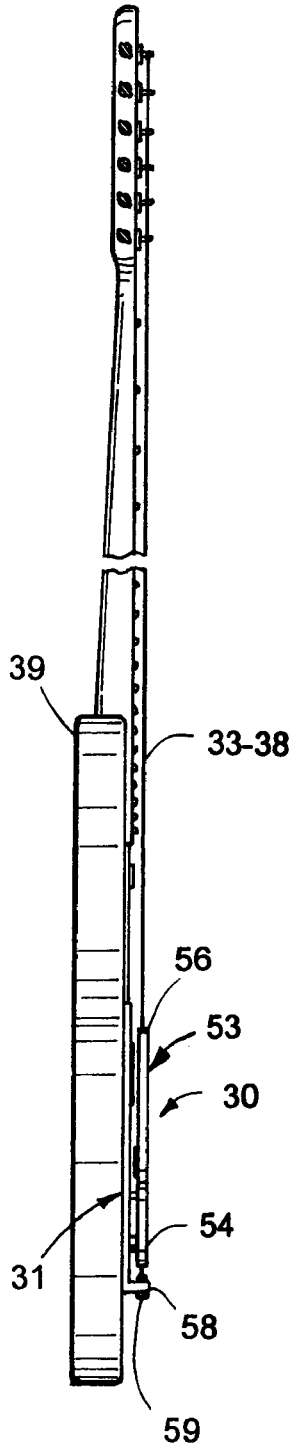
Figure 2A:
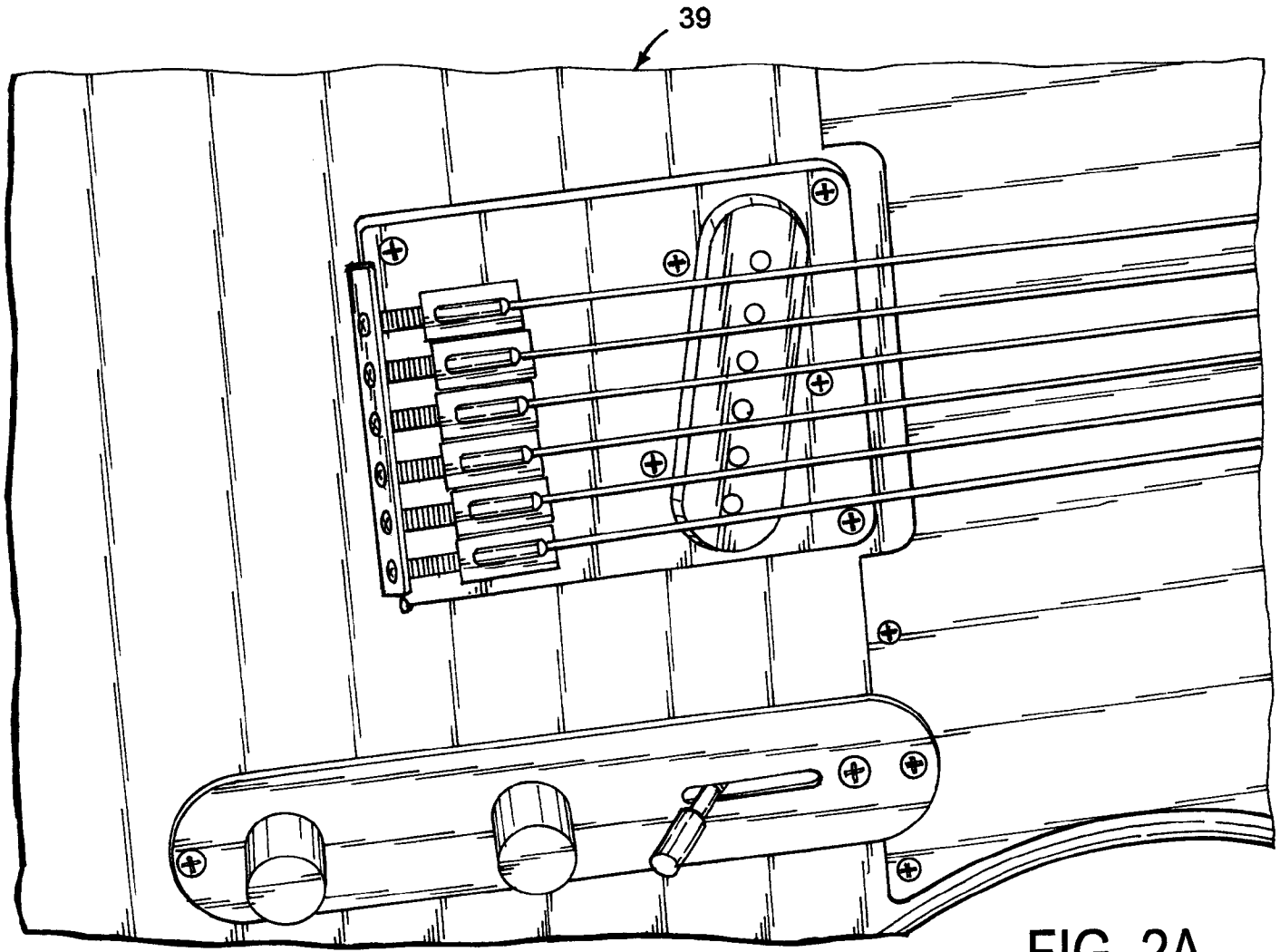
FIG. 2A PRIOR ART
FIG. 2A is a front fragmentary view of a guitar similar to the one in FIG. 1 but with a prior art tailpiece thereon.
Figure 6:
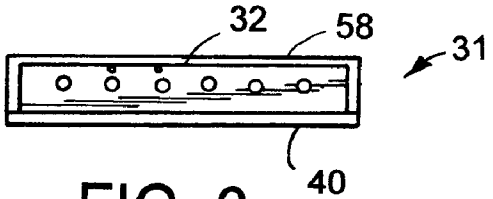
FIGS. 3-6 are perspective, top, side and end views of the string bender of FIGS. 1-2, FIGS. 3-4 showing the complete assembly with mounting plate, handle, and adjustable stop, and FIGS. 5-6 showing only the mounting plate and attached flanges/pivots.
Figure 3:
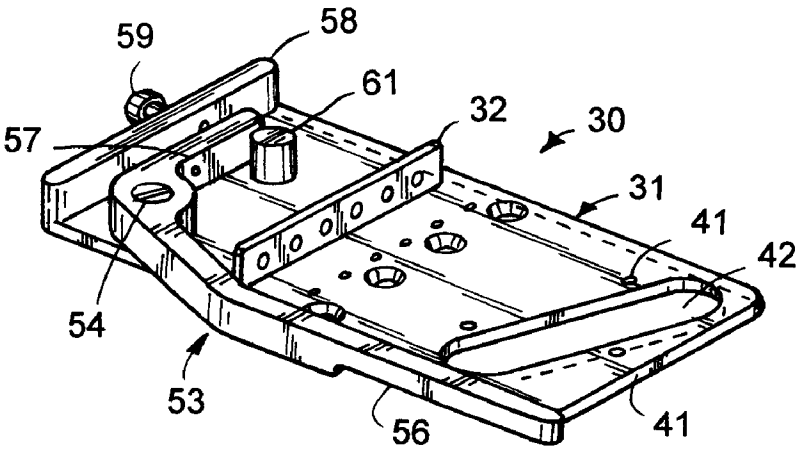
Figure 4:
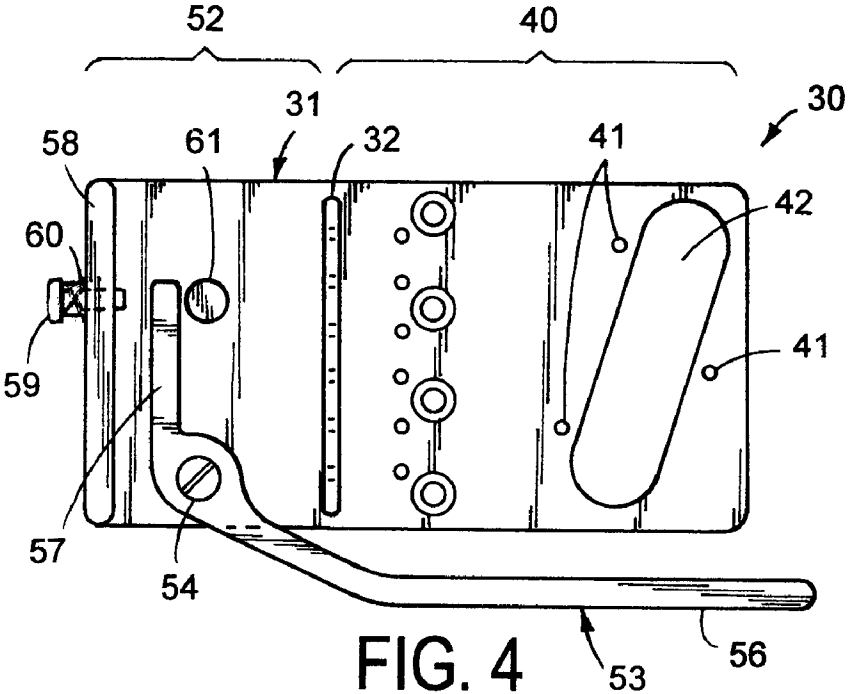
Figure 5:
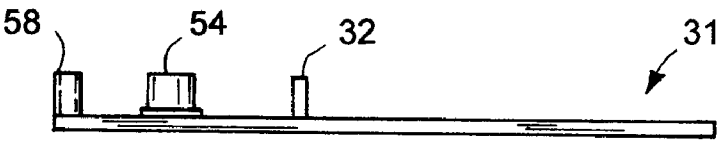
Figure 7:
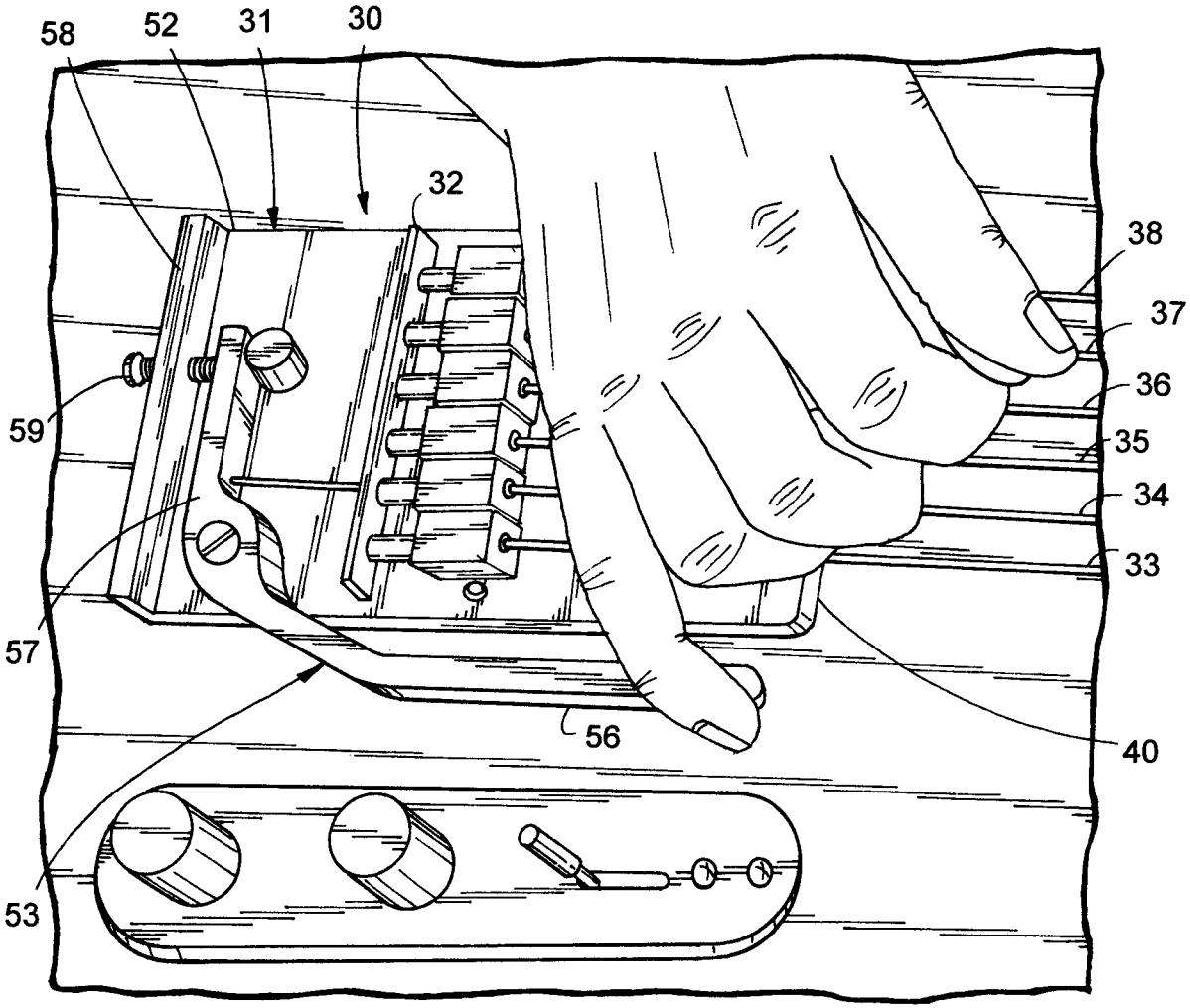
FIG. 7 is a perspective view of FIG. 1 and showing a player's hand positioned to strum and also positioned to use the string bender.
Figure 11:
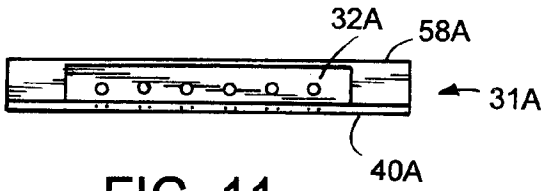
FIGS. 8-11 are perspective, top, side and end views of a second embodiment of the present inventive string bender, the string bender of FIGS. 8-11 being similar to FIGS. 3-6 but with a shorter base plate that ends short of the sound pickup, FIGS. 8-9 showing the complete assembly with mounting plate, handle, and adjustable stop, and FIGS. 10-11 showing only the mounting plate and attached flanges/pivots.
Figure 8:
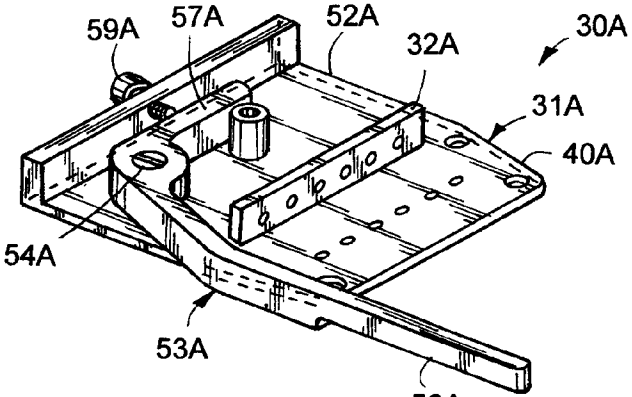
Figure 9:
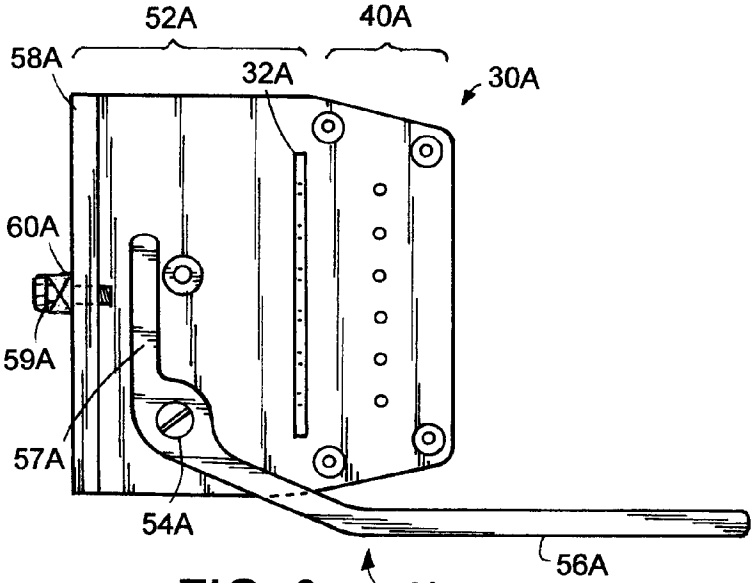
Figure 10:
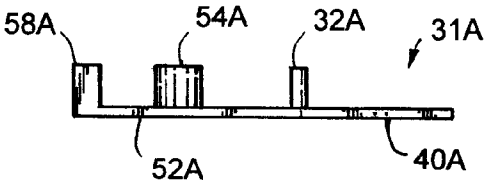
Figure 15:
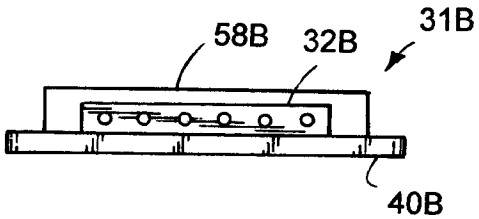
FIGS. 12-15 are perspective, top, side and end views of a third embodiment of the present inventive string bender, the string bender of FIGS. 12-15 being similar to FIGS. 3-6 but with a configured extension for selectively supporting the third embodiment string bender or a Bigsby vibrato, FIGS. 12-13 showing the complete assembly with mounting plate, handle, and adjustable stop, and FIGS. 14-15 showing only the mounting plate and attached flanges/pivots.
Figure 12:
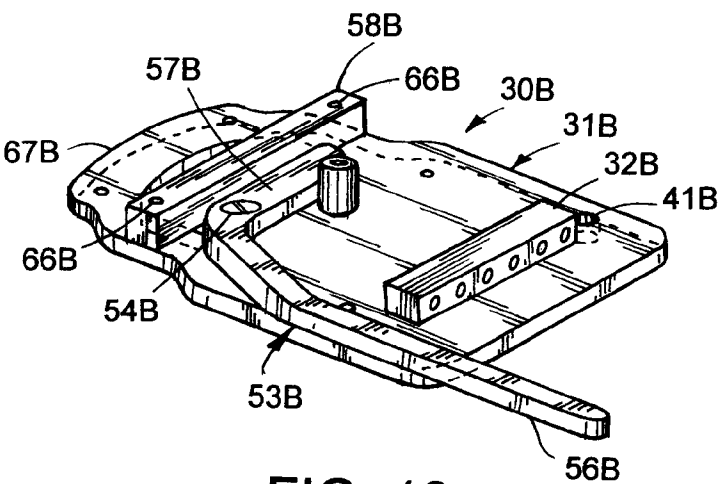
Figure 13:
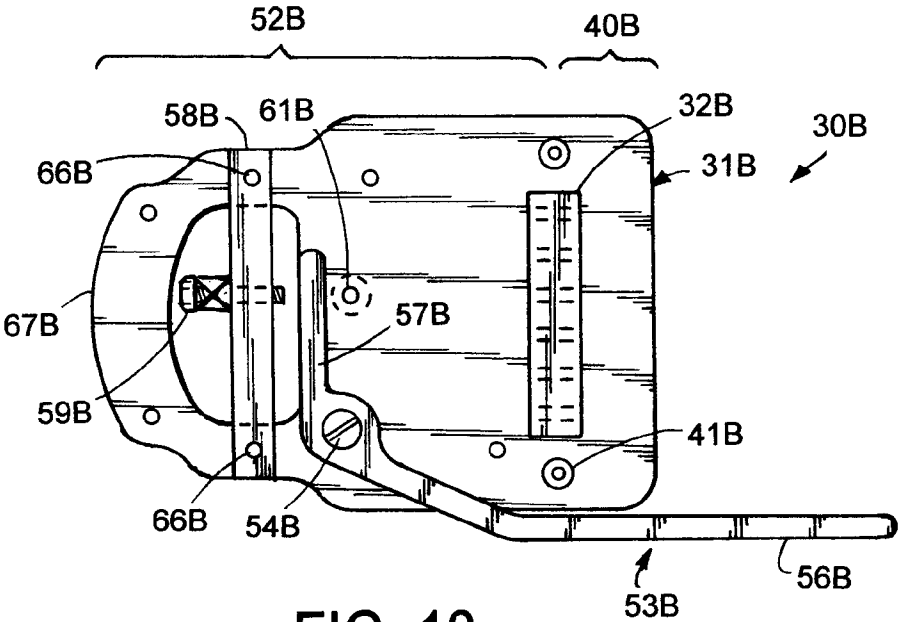
Figure 14:
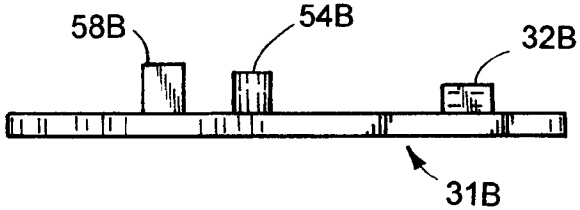

A string bender apparatus 30 (FIGS. 1-7) includes a mounting plate 31 with an anchor flange 32 for anchoring guitar strings 33-38 to a guitar body 39, a first section 40 (FIG. 4) with fastener-receiving holes 41 (only three shown) arranged to receive fasteners 46 extended into pre-existing mounting holes in the body 39, and an extension 52 that extends in-plane from the first section 40. The present invention includes making the first section 40 and the flange 32 very similar to the existing tailpiece (see FIG. 2A) that is being replaced on a given guitar, so that similar fastener attachment holes and string attachment are provided, and so that parts from the existing tailpiece (such as fasteners, existing bridge parts, etc.) can be used. The first section 40 includes an angled aperture 42 for receiving the sound pickup on the guitar body 39. A lever 53 is pivoted to the extension 52 at location 54, such as by a lubricious shoulder bolt or the like, for pivotal movement about an axis perpendicular to a front surface of the guitar body 39. When the lever 53 is moved in a plane that extends generally parallel the front surface of the guitar body 39 (i.e., parallel a plane of the strings), it stretches the strings (34 or 35) attached to the lever 53. The lever 53 includes a first end defining a handle 56 that is positioned generally adjacent a lower side of the strings 33-38 and includes an opposite end 57 attached to one or two of the strings (such as the B string 34 and/or the G string 35) for temporarily changing a tension of the string(s) and thus changing a pitch of the string(s) when the handle 56 is moved in the plane. A tension of the strings 34 (or 35) returns the lever 53 to its home position. A second flange 58 extends parallel the first flange 32, and includes a stop 59 that limits movement of the end 57 to prevent over-stretching. The illustrated stop 59 is a threaded shaft that can be adjusted to change its stop point, and either includes a compression spring 60 (FIG. 4) to secure it in a set position, or alternatively includes sufficient a locking nut or friction on its threads to prevent undesired "self-adjustment" during use. A stop 61 abuts the lever 53 and holds it in a home position.

Advantageously, the illustrated apparatus 30 of FIGS. 1-7 uses few components (e.g., the mounting plate and lever) and is relatively simple in operation, such that it very cost effective and robust. For example, a separate spring is not needed to return the string bender to its home position, since a tension of the connected strings pulls the string bender directly and reliably toward its home position. At the same time, the illustrated string bender integrates well into the act of playing/picking/strumming the guitar, such that it does not interfere with or require significant change in a player's routine. Advantageously, the present string bender 30 can be retrofit onto existing guitars using existing anchor attachment locations for each guitar's existing mounting plate. It is contemplated that the illustrated mounting plate can be replaced with a different mounting plate adapted to support different structures on the guitar, such as a vibrato or a combination including both a string bender and a vibrato.

The illustrated string bender device 30 according to FIGS. 1-7 is for a Fender Mexican Telecaster brand guitar or similar configuration. It uses existing bridge parts from the guitar being retrofit. Once installed, the player has the added option of choosing bending of the B string or G string for pedal steel guitar effects with a simple pull of the handle, the pull being in a same plane as the natural picking/playing/strumming movement of the player's hand.

Notably, installation is quite simple and fast. The existing strings and bridge components are removed, the bridge plate is removed, the new mounting plate is installed using the existing screw apertures for the removed bridge plate, the existing bridge components are reinstalled to the new mounting plate or frame, and the guitar is restrung. Installation is then complete.

As noted above, the particular illustrated string bender apparatus 30 of FIGS. 1-7 is for Fender Mexican Telecaster brand guitar. However, it is specifically contemplated that most of the present inventive concepts can be used on other guitars and instruments. For example, the concept of providing a replacement mounting plate with in-plane extension (52) and pivoted lever (53) can be widely used to construct a replacement tailpiece for supporting the present string bender on basically any known guitar, including different Fender electric guitars (such as Fender's "non-Mexican" Telecaster guitar, Fender's Squire guitar, and Fender's Stratocaster guitar) as well as other guitars (such as Gibson and Epiphone guitars).

Additional embodiments are described below using the same identification numbers to describe similar or identical components, features, and characteristics, but with the additional of letters "A", "B," etc. This is done to reduce redundant discussion. However, those skilled in the art will understand the inter-relationship and cross over of related concepts.

FIGS. 8-11 illustrate a second string bender apparatus 30A, the string bender 30A being similar to the string bender 30 of FIGS. 3-6 but with a shorter base plate. For example, the first section 40A does not include any angled aperture for receiving a sound pickup on the guitar body. The illustrated apparatus 30A is used on a Nighthawk guitar.

Figure 16:
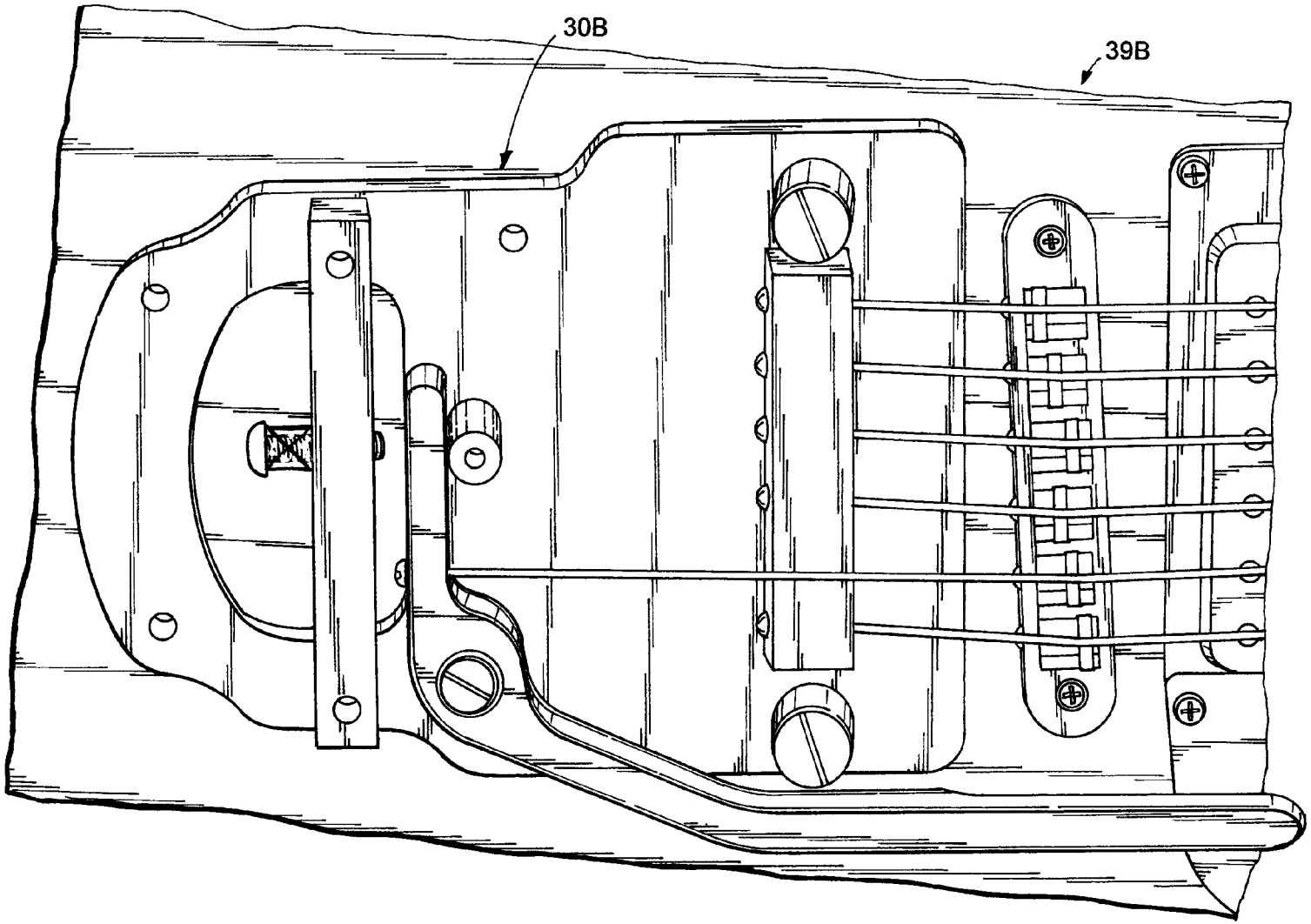
FIGS. 16-17 are fragmentary perspective views showing the third embodiment string bender on a guitar (FIG. 16) and the Bigsby vibrato on a guitar (FIG. 17) using the same mounting plate as shown in FIG. 12.
Figure 17:
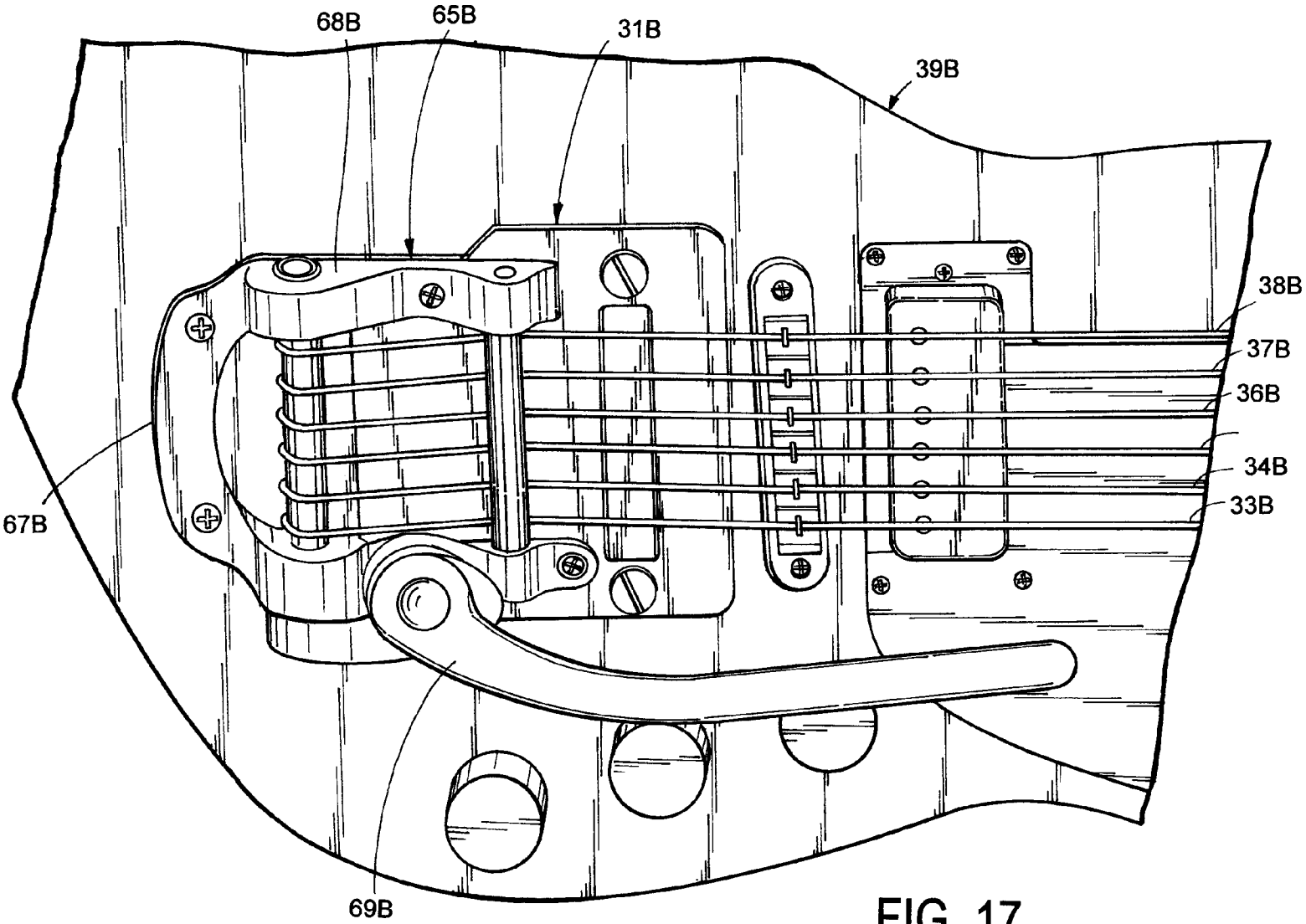
Figure 21:
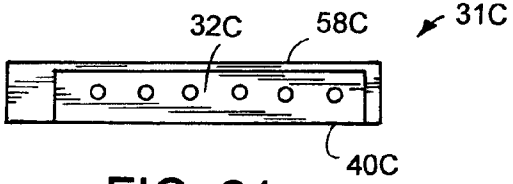
FIGS. 18-21 are perspective, top, side and end views of a fourth embodiment of the present inventive string bender, the string bender of FIGS. 18-19 being similar to FIGS. 3-6 but with a mounting plate configured to support both a string bender and a vibrato, FIGS. 18-19 showing the complete assembly with mounting plate, handle, and adjustable stop, and FIGS. 20-21 showing only the mounting plate and attached flanges/pivots.
Figure 18:
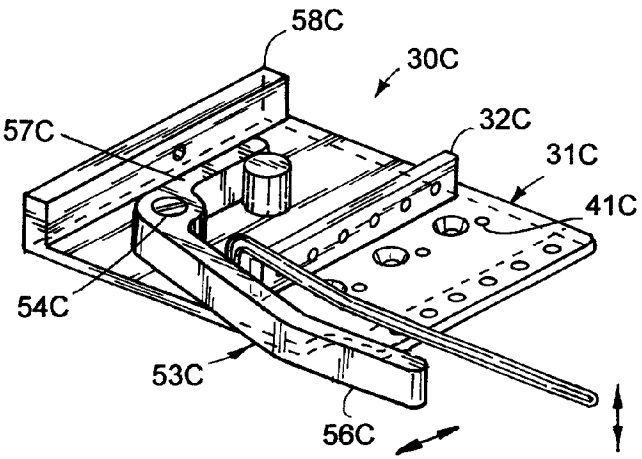
Figure 19:
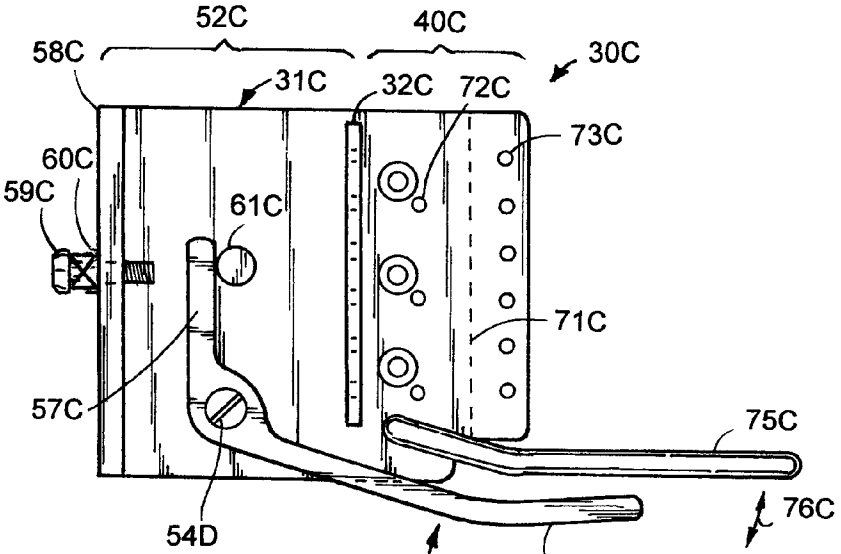
Figure 20:
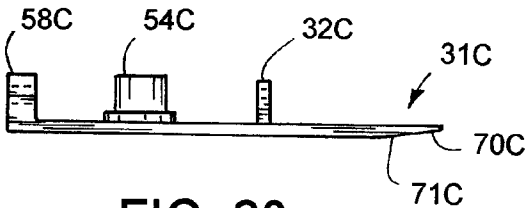

FIGS. 12-15 illustrate a third string bender apparatus 30B similar to the string bender 30A, but with an extension 52B configured to optionally support the bender lever 53B or alternatively support a well known "Bigsby vibrato" 65B (FIG. 17). Specifically, the rear flange 58B (FIGS. 12-13) is removably bolted to the extension 52B by threaded fasteners 66B. Also, the lever 53 can be removed by removing the fastener forming its pivot. Further the extension 52B includes a rearwardly extending portion 67B. The Bigsby vibrato 65B (FIG. 17) includes a frame 68B fastened to the extension 52B using the fasteners 66B and additional similar fasteners at a rear of the extension 66B. The Bigsby vibrato 65B includes a handle 69B pivoted to the frame 68B for simultaneously bending all six strings 33B-38B. FIG. 16 shows the present string bender apparatus 30B with the lever 53B and rear flange 58B attached, and FIG. 17 shows the apparatus 30B with those components removed and the Bigsby vibrato 65B installed.

FIGS. 18-21 illustrate a third string bender apparatus 30C, the string bender 30C being similar to apparatus 30 but with a mounting plate 31C configured to support both a string bender lever 53C and a vibrato 65B. The front section 40C is modified to include a narrowed front edge section 70C having an angled bottom surface forming a transverse pivot location 71C. The fasteners at rear locations 72C and/or at front locations 73C secure the mounting plate 31C to the body (39) of a guitar, with fasteners at locations (72C) rear of the pivot 71C permitting the extension 52C of the mounting plate 31C to pivot upward when handle 75C is depressed toward the guitar body (39). For example, springs can be positioned on the fasteners at the locations 72C to allow clearance for movement of the plate 31C while also biasing the mounting plate 31C back to a home position flat against the front of the guitar body (39). Notably, the handle 53C of the string bender 30C and also the handle 69C of the vibrato do not interfere with each other. It is noted that the handles 53C and 69C operate in different directions. It is also noted that the handle 75C can be swung along line 76C (parallel a front surface of the guitar body (39) to different storage positions.

Figure 22:
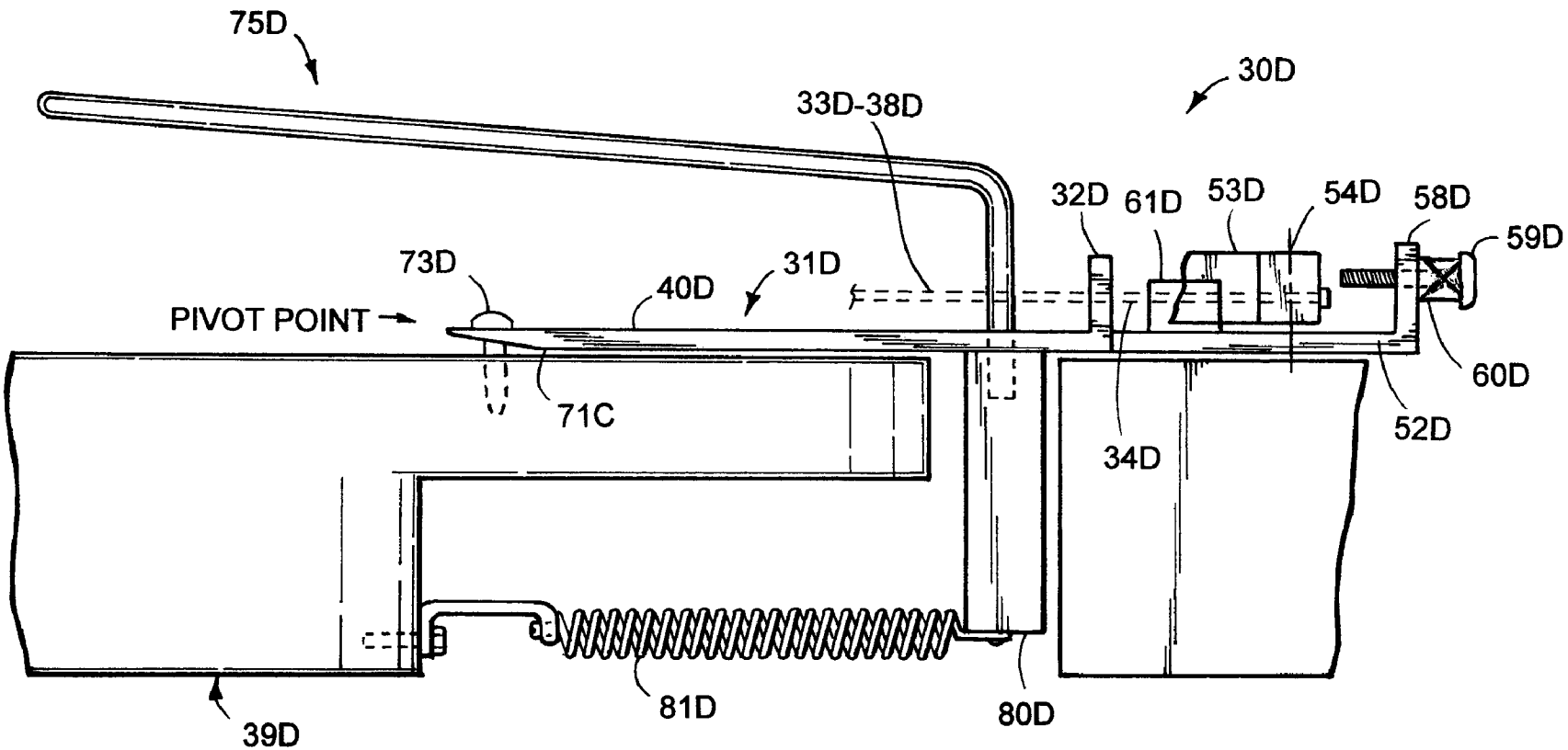
FIG. 22 is a cross section through a guitar having the string bender of FIG. 18 mounted thereon, FIG. 22 showing attachment details.

FIG. 22 illustrates a third string bender apparatus 30D, the string bender 30D being similar to apparatus 30C but with its mounting plate 31D having a block 80D that extends through the guitar body 39D. Springs 81D are attached to the block 80D in a manner that biases the mounting plate 31D toward a down position against the front surface of the guitar body 39D. However, by pressing the handle 75D, the vibrato can be activated. Also, by pressing the handle 53C, the string bender can be activated. Thus, the arrangement of apparatus 30D is configured to support both a string bender lever and a vibrato. It is noted that the first section 40D and flange 32D are not unlike those already available for a Fender Stratocaster guitar . . . but the extension 52D and related components are new and considered to be part of the present invention.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A method of retrofitting a guitar with a new function, comprising steps of:

providing a guitar having a body with a front surface defining a plane and having a tailpiece anchor attached to the body using fasteners and pre-existing fastener holes arranged in a known pattern, the tailpiece anchor anchoring guitar strings to the body over the front surface in a string-tensioned arrangement;

removing the guitar strings;

removing the fasteners and then removing the tailpiece;

providing a string bender that includes a mounting plate with holes matching the known pattern and a lever pivoted to the mounting plate for movement; the lever including a first end defining a handle that is positioned generally adjacent one side of the strings when the strings are in the string-tensioned arrangement and including an opposite end attached to one of the strings for temporarily changing a tension of the one string and thus changing a pitch of the one string when the handle is moved;

attaching the mounting plate to the body by extending the fasteners through the holes into the pre-existing fastener holes in the body; and re-attaching the strings by attaching most strings to the mounting plate but also attaching at least one of the strings to the opposite end of the lever.

2. A method of retrofitting a guitar with a new function, comprising steps of:

providing a guitar having a body with a front surface defining a plane and having a tailpiece anchor attached to the body using fasteners and pre-existing fastener holes arranged in a known pattern, the tailpiece anchor anchoring guitar strings to the body over the front surface in a string-tensioned arrangement; removing the guitar strings;

removing the fasteners and then removing the tailpiece;

providing a vibrato that includes a mounting plate with holes matching the known pattern and a lever pivoted to the mounting plate for movement; the lever including a first end defining a handle and including an opposite end operably attached to the strings for temporarily changing a tension of the strings to thus change a pitch of the strings when the handle is moved;

attaching the mounting plate to the body by extending the fasteners through the holes into the pre-existing fastener holes in the body; and re-attaching the strings by attaching most strings to the mounting plate but also attaching at least one of the strings to the opposite end of the lever.

* * * * *